United States Patent [19]

Barkow et al.

[11] 4,218,667

[45] Aug. 19, 1980

[54] CONVERGENCE ADJUSTMENT ARRANGEMENT USING MAGNETIC TABS WITH DIFFERENTIAL MOTION

[75] Inventors: William H. Barkow, Pennsauken; Robert W. Shisler, New Egypt, both of N.J.

[73] Assignee: RCA Corporation, New York, N.Y.

[21] Appl. No.: 18,906

[22] Filed: Mar. 9, 1979

Related U.S. Application Data

[63] Continuation-in-part of Ser. No. 951,001, Oct. 13, 1978, abandoned.

[51] Int. Cl.[2] ..... H01F 1/00

[52] U.S. Cl. ..... 335/212; 335/210

[58] Field of Search ..... 335/210, 211, 212, 214; 313/430

[56] References Cited

U.S. PATENT DOCUMENTS

| | | | |
|---|---|---|---|
| Re. 27,698 | 7/1973 | Werst | 335/212 |
| 3,290,533 | 12/1966 | Ammerman | 335/212 X |
| 3,605,053 | 9/1971 | Anthony | 335/212 |
| 3,781,731 | 12/1973 | Poel | 335/212 |
| 3,852,693 | 12/1974 | Schwalm | 335/212 |
| 3,942,146 | 3/1976 | LaBelle | 335/212 |

FOREIGN PATENT DOCUMENTS

| | | | |
|---|---|---|---|
| 1387463 | 3/1975 | United Kingdom | 335/212 |
| 1535192 | 12/1975 | United Kingdom | 335/212 |

*Primary Examiner*—George Harris

*Attorney, Agent, or Firm*—P. J. Rasmussen; W. H. Meise; S. J. Stevens

[57] ABSTRACT

Vertical translation of a self-converging deflection yoke relative to an in-line TV kinescope may be necessary to achieve satisfactory raster distortion. The vertical translation of the yoke may cause a residual convergence error. The residual convergence error may be eliminated by means of first and second permeable tabs mounted on the yoke and arranged for simultaneous vertical adjustment.

11 Claims, 8 Drawing Figures

Fig.1
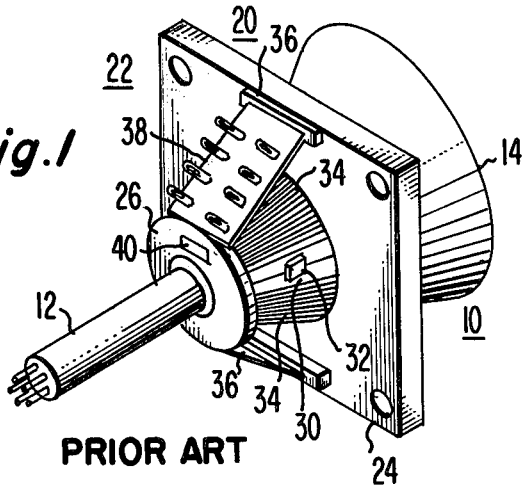
PRIOR ART
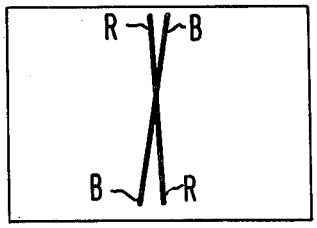
Fig. 2
Fig.3
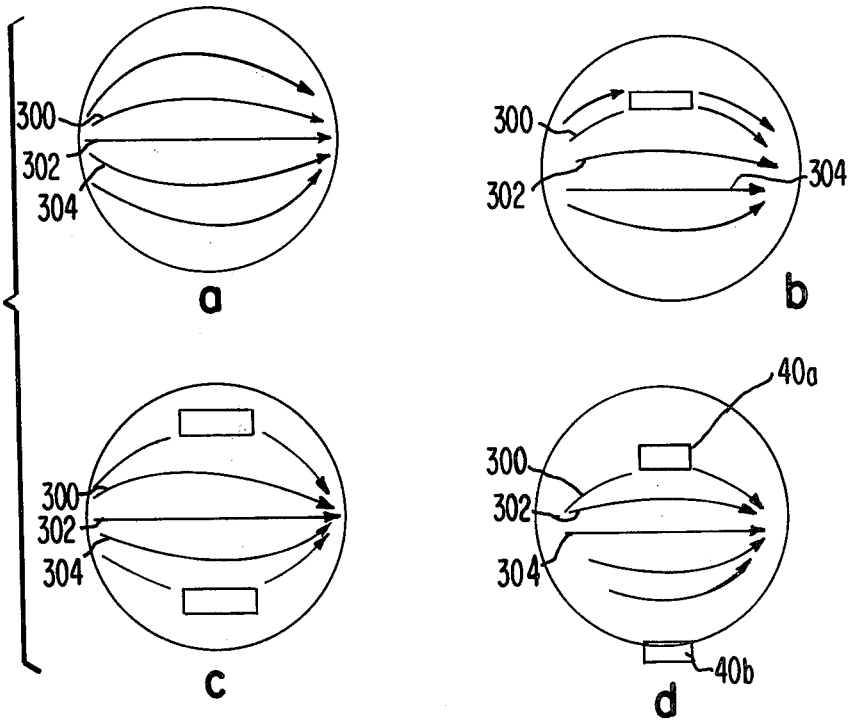

CONVERGENCE ADJUSTMENT ARRANGEMENT USING MAGNETIC TABS WITH DIFFERENTIAL MOTION

This application is a continuation-in-part of application Ser. No. 951,001 filed Oct. 13, 1978, now abandoned.

This invention relates to a convergence adjustment for a color TV kinescope display arrangement.

Color television kinescopes or picture tubes create images having portions of different colors by causing electrons to impinge upon or illuminate phosphors having different emissions. Normally, phosphors having red, green and blue light emission are used, grouped into myriad trios or triads of phosphor areas, with each triad containing one phosphor area of each of the three colors.

In the kinescope, the phosphors of each of the three colors are illuminated by an electron beam which is intended to impinge upon phosphors of only one color. Each electron beam has a relatively large cross-section compared with a phosphor triad, and each beam illuminates several triads. The three electron beams are generated by three electron guns located in a neck portion of the kinescope opposite the viewing screen formed by the phosphors. The electron guns are oriented so that the beams as generated leave the guns in parallel or somewhat converging paths directed towards the viewing screen. In order to allow the display of a gamut of colors, the phosphor array in a given area must be illuminated by the three electron beams with an intensity dependent upon the color to be displayed. The three electron beams leaving the electron guns in separate parallel paths will if uncorrected illuminate the viewing screen in three different locations, forming separated dots of different colors. In order to enable a single illuminated area to display a color gamut, the electron beams are caused to converge at or near the viewing screen. At the center of the screen, this may be accomplished by the use of a permanent magnet assembly mounted in the neck region of the kinescope for producing a static magnetic field which causes the three beams to converge or register at the center of the viewing screen. This adjustment is known as "static convergence".

With the three electron beams illuminating the same area of the viewing screen, some means must be provided for causing each of the red, green and blue beams to illuminate only its respective phosphor. This is accomplished by the shadow mask. The shadow mask is a conductive screen or grill having large numbers of perforations through which portions of the electron beams may pass. Each perforation is in a fixed position relative to each triad of color phosphor areas. Portions of the converged electron beams pass through one or more of the perforations and the portions begin to diverge and separate as they approach the viewing screen. At the viewing screen the portions are separated and fall upon the appropriate phosphor color based upon the direction of electron beam incidence. That is, each electron beam approaches a given group of perforations from a slightly different direction and the beams are split into a number of smaller beams which diverge slightly after passing through the perforation and before falling upon the appropriate individual color phosphor areas. The method depends upon a high order of accuracy in the placement of the phosphor triads relative to the perforations and the apparent source of the electron beams. In order to insure that the apparent source of the electron beams is correct, a "purity" adjustment is made by which each beam is caused to illuminate only a particular one of the phosphor areas of each triad.

In order to form a two-dimensional image, the lighted dot on the viewing screen caused by the three statically converged electron beams must be moved both horizontally and vertically over the viewing screen to form a lighted raster area. This is accomplished by means of magnetic fields produced by a deflection yoke mounted upon the neck of the kinescope. The deflection yoke commonly deflects the electron beam with substantially independent horizontal and vertical deflection systems. Horizontal deflection of the electron beam is provided by pairs of conductor arrays of the yoke which produce a magnetic field having vertically extending field lines. The amplitude of the magnetic field is varied with time at a relatively high rate. Vertical deflection of the electron beams is accomplished by pairs of conductor arrays producing a horizontally extending magnetic field which varies with time at a relatively low rate.

A permeable magnetic core is associated with the yoke conductors. The conductors are formed into continuous windings or coils by return conductors which may enclose the core within the coil to form a toroidal deflection winding, or which form a saddle coil winding if the coil does not enclose the core.

The viewing screen is relatively flat. The electron beam, which traverses a given distance from the point or center of deflection to the center of the viewing screen, will traverse a greater distance when deflected towards the edge of the viewing screen. From geometrical considerations, it may be expected that the electron beams will converge at a point on the surface of a sphere centered at the point of deflection. This alone would result in a separation of the landing points of the three electron beams near the edge of the screen. In addition, unavoidable longitudinal components of the deflecting magnetic fields cause the electron beams to be more strongly converged whereby the surface at which the beams converge is further distorted. These effects combine to cause the light spots generated by the three beams at points away from the center of the viewing screen to be separated, even though each of the beams illuminates only its appropriate color phosphor. This is known as misconvergence, and results in color fringes about the displayed images. A certain amount of misconvergence is tolerable, but complete separation of the three illuminated spots is generally not. Misconvergence may be measured as a separation of the ideally superimposed red, green and blue lines of a crosshatch pattern of lines appearing on the raster as an appropriate test signal is applied to the receiver.

Formerly, kinescopes had the electron guns in a triangular or delta configuration. Convergence of the electron beams to form a coalesced light spot at points away from the center of the viewing screen was accomplished in delta-gun systems by dynamic convergence arrangements including additional convergence coils mounted about the neck of the kinescope and driven at the deflection rates by dynamic convergence circuits, as described in U.S. Pat. No. 3,942,067 issued Mar. 2, 1976 to Cawood.

As described in U.S. Pat. No. 3,789,258 issued Jan. 29, 1974 to Barbin, and in U.S. Pat. No. 3,800,176 issued Mar. 26, 1974 to Gross, et al. current television display arrangement utilize an in-line electron gun assembly together with a self-converging deflection yoke arrangement including deflection windings for producing negative horizontal isotropic astigmatism and positive vertical isotropic astigmatism for balancing the convergence conditions of the beams on the deflection axes and in the corners such that the beams are substantially converged at all points on the raster. This eliminates the need for dynamic convergence coils and circuits. With the increased deflection angles necessitated by commercially desirable short kinescopes, the deflection yoke is required to correct for pincushion and other raster distortions as well as providing satisfactory self-convergence. The magnetic field nonuniformity providing the isotropic astigmatism necessary for self-convergence makes the convergence dependent upon the position of the longitudinal axis of the yoke relative to the longitudinal axis of the kinescope. This sensitivity together with normal manufacturing tolerances makes it necessary to adjust the yoke transversely relative to the kinescope to achieve the best compromise convergence, but may affect the raster distortion. If a position is selected for the yoke in which the raster distortion is satisfactory, there may be a residual convergence error. It is known that placing a permeable tab adjacent the yoke can correct the residual convergence error, but finding the correct side of the kinescope on which to apply the tab, locating the proper position and affixing the tab to the yoke with glue is time-consuming, because the alignment operator is normally in front of the kinescope while performing other alignments, and must be behind the kinescope to add the tabs. It is desirable to have an arrangement by which an alignment operator may conveniently correct residual convergence error.

SUMMARY OF THE INVENTION

A convergence correction arrangement for a deflection yoke adapted to be disposed about and coaxial with an in-line beam kinescope comprises first and second magnetic field influencers located on opposite sides of the axis. A mounting arrangement maintains a fixed separation between the influencers and provides for differential adjustment of the influencers relative to the axis.

DESCRIPTION OF THE DRAWING

FIG. 1 is a perspective view of a kinescope and yoke assembly accordingly to the prior art;

FIG. 2 represents a residual convergence error which may require correction;

FIG. 3 represents magnetic field patterns useful in explaining the operation of the invention;

DESCRIPTION OF THE INVENTION

Figure 4:
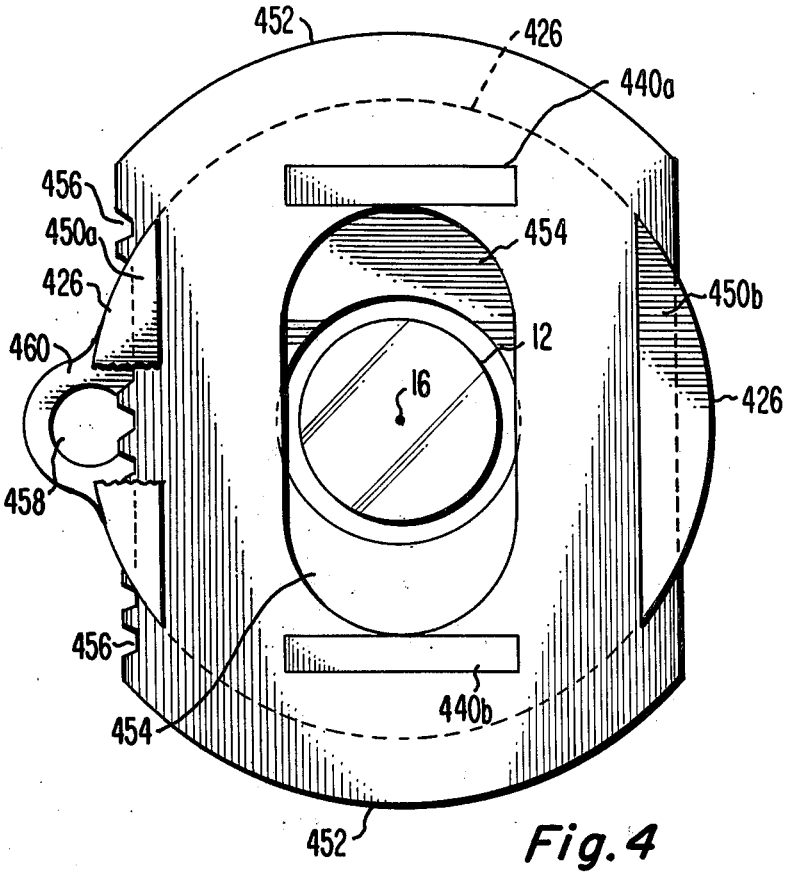
FIGS. 4 and 5 are rear and perspective views, respectively, of portions of a kinescope and yoke assembly embodying the invention.

FIG. 1 illustrates a prior art kinescope and yoke arrangement. In FIG. 1, a kinescope designated generally as 10 includes a neck portion 12 containing the electron guns and a flared portion 14 through which the deflection electron beams pass to strike a phosphor screen. A yoke assembly designated generally as 20 includes a yoke mount 22 adapted to be fastened to kinescope 10 for supporting the various parts of the yoke and holding the yoke substantially coaxial with the kinescope. Mount 22 includes a forward portion 24 and rear portion 26 between which are placed two halves of a core 30 clipped together by a fastener 32. Each half of core 30 is associated with a toroidally wound vertical deflection winding 34. Pincushion correction magnets 36 are fastened at the top and at the bottom of front portion 24 of yoke mount 22. The various terminals of windings 34 and of the horizontal deflection windings, not shown, are fastened to terminals on a terminal board 38. As so far described, the deflection yoke is similar to that described in U.S. patent application Ser. No. 938,243 filed Aug. 30, 1978 in the name of William H. Barkow.

As known, it may be necessary to move yoke assembly 20 transversely in order to achieve optimum raster distortion. For example, the yoke described in the aforementioned Barkow application may desirably be moved transversely during factory alignment in order to obtain optimum pincushion distortion.

Vertical translation of the yoke relative to the kinescope may result in a small amount of convergence error of the form illustrated in FIG. 2. In FIG. 2, the red and blue vertical lines through the center of the raster are illustrated as separated. The separation, of course, may have blue on the left and red at the right at the top of the raster for the opposite direction of yoke translation. This is normally corrected in known fashion by placing a permeable tab illustrated as 40 in FIG. 1 near the rear portion 26 of yoke mount 22, either above or below neck 12 of the kinescope. When the correct side of the neck to which the tab should be affixed is determined, the tab is temporarily affixed in an approximate position and the resulting convergence is viewed at the front of the kinescope. If the position is correct, the operator then affixes the permeable tab permanently in position. If adjustment of the position of the tab is required, a further approximate position is selected, and the result is again viewed at the front of the kinescope, and the procedure is continued until a satisfactory result is obtained. This method is time-consuming because the operator must repeatedly move from front to back of the kinescope and yoke being aligned.

FIG. 3*a* illustrates the ideal barrelled field produced by the vertical deflection windings in the vicinity of neck 12. The presence of a magnetically permeable tab 40 perturbs the horizontal magnetic field lines and tends to increase the bowing of the field lines such as lines 300 in the vicinity of the tabs, as illustrated in FIG. 3*b*. The straight field lines such as 302 which previously defined the center of the yoke field also become bowed, and previously curved lines such as 304 becomes straight and define the new center of the field. The presence of a tab can be thought of as tending to move the effective center of the field away from the tab. Thus, the effective center of the deflection field near the entrance end of the yoke can by use of a permeable tab be repositioned slightly relative to the mechanical center.

FIG. 3*c* illustrates the result of using two tabs equidistant from the center of the yoke field. The center of the field remains unchanged. However, when a pair of tabs are used in an asymmetrical configuration, such as illustrated by tabs 40*a* and 40*b* in FIG. 3*d*, the influence of tab 40*b* is exceeded by that of 40*a* and the center of the field is changed.

Figure 5:
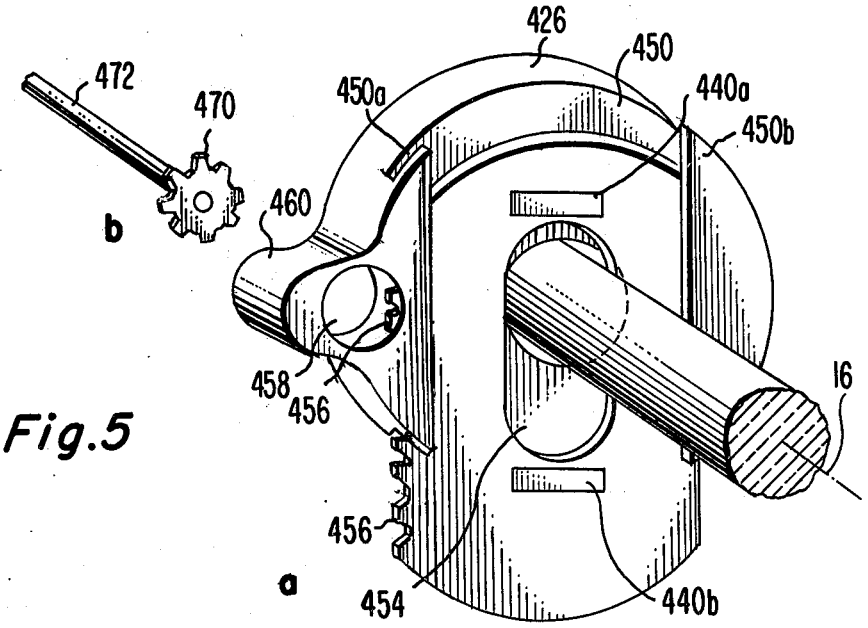

FIGS. 4 and 5 illustrate portions of a kinescope and yoke assembly embodying the invention. In FIG. 4, the rear portion of a yoke mount is designated 426 and forms channel portions 450*a* and 450*b*. A plate 452 is arranged to slide in channel 450 formed by portions 450*a* and 450*b*. Plate 452 has an elongated central aperture 454 wider than the neck 12 of kinescope 14 to allow motion of plate 452 in the vertical direction without interference by the neck. First and second magnetic field influencing means in the form of a pair of permeable tabs 440*a* and 440*b* are affixed within suitable recesses in plate 452. The tabs are maintained on opposite sides of an axis 16 of kinescope 14 by plate 452 and are contiguous with the yoke assembly.

Both plate 452 and rear portion 426 of the yoke mounting are formed of a resilient thermoplastic material. Plate 452 is slightly thicker in the central region near the permeable tabs than at the edges riding in the channel. The taper of the thickness of plate 452 is dimensioned relative to the size of channels 450*a* and 450*b* to provide a friction fit to prevent undesired motion of plate 452 during and after adjustment. Adjustment of plate 452 is effected by means of a gear rack 456 molded into the side of plate 452 which rides in channel 450*a*. A through hole 458 formed in an enlarged portion 460 of yoke mounting 426 is dimensioned to expose a portion of channel 450*a* to provide a location for gear drive of rack 456. A gear illustrated as 470 of FIG. 5*b* has a diameter adapted to fit into hole 458 and mates with the teeth of rack 456. Gear 470 is connected to a flexible drive shaft 472.

In operation, the kinescope and yoke assembly being aligned is placed in a yoke adjustment machine (YAM) by which the position of the yoke relative to the kinescope can be adjusted from the screen side of the kinescope. The operator, located in front of and viewing the screen of the kinescope, adjusts the position of the yoke for best raster distortion. In order to correct residual convergence error, the operator turns gear 470 by means of flexible shaft 472, thereby moving plate 452 up or down relative to the yoke and kinescope as required.

Vertical motion of plate 452 causes a differential motion of tabs 440*a* and 440*b* towards axis 16; i.e., when tab 440*a* moves towards neck 12 and axis 16, tab 440*b* moves away. This results in a shift of the center of the deflection field as described in conjunction with FIG. 3 and may be used to correct the residual convergence error. Gear 270 is then removed from hole 458, and the kinescope-yoke assembly is ready for use. If desired, glue may be used to hold plate 452 and thereby prevent inadvertent misadjustment.

Figure 6:
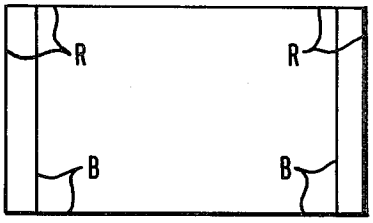
FIG. 6 illustrates another form of convergence error which may be corrected by an arrangement according to the invention.

The same principle can be applied in the horizontal direction. A form of convergence error involving raster size is illustrated in FIG. 6. The horizontal size or width of the red raster is greater than that of the blue raster. The green or center-beam raster (not shown) lies midway between. This distortion may be corrected by an arrangement similar to that illustrated in FIGS. 4 and 5 providing differential motion of the tabs in a horizontal plane.

Figure 7:
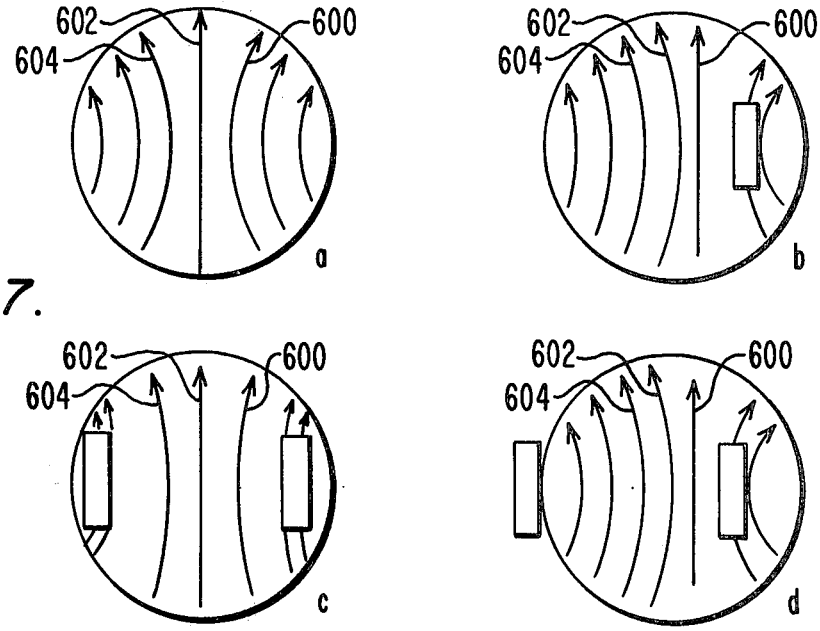
FIG. 7 represents horizontal deflection magnetic field patterns useful in explaining the invention.

FIG. 7*a* illustrates an unmodified pincushion-shaped magnetic field (or a field having negative isotropic astigmatism). The pincushion-shaped magnetic field lines indicate that the greatest magnetic field strength lies to the left and the right of the region illustrated, i.e., on the horizontal axis. Field line 602 is straight, representing as in the case of FIG. 3 the center of the magnetic field. The presence of a single tab horizontally displaced to the right from the axis of the kinescope as in FIG. 7*b* results in a curvature to field line 602 and straightens field line 600. The tab may be viewed as isolating or shielding the axis region of the kinescope from the region of greatest magnetic field strength on the right, whereby the field from the left becomes more influential. The straightening of field line 600 moves the effective center of the magnetic field to the right.

The use of a pair of tabs symmetrically located with respect to the axis results in a symmetrical field configuration similar to the unmodified field in FIG. 7*a*. Offsetting the pair of tabs to the left as illustrated in FIG. 7*d* straightens field line 600 and moves the effective center of the magnetic field to the right, thereby providing the same result as the single tab of FIG. 7*b*. The tabs are positioned so as to cause the red and blue rasters to overlap.

Figure 8:
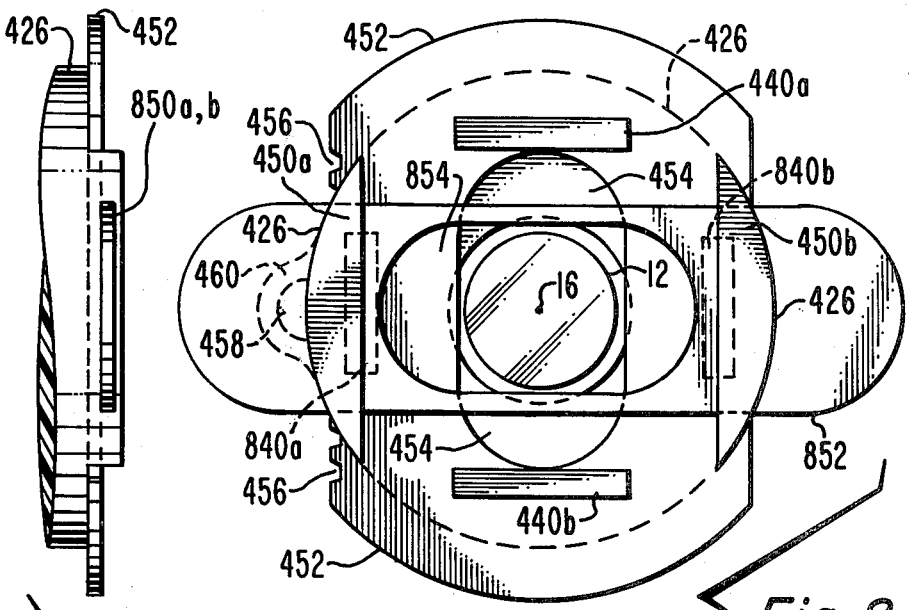
FIG. 8 illustrates in side and rear views an arrangement according to the invention by which two forms of converged error may be corrected independently.

Both horizontal and vertical motion of the tabs may be provided by mounting the four tabs on a wobble plate providing vertical and horizontal motion. However, this may result in undesirable interdependence of the adjustments. Independent motion in each of two orthogonal directions may be provided by a pair of independent sliding supports as illustrated in FIG. 8. In FIG. 8, elements corresponding to those of FIG. 4 are provided with the same reference numbers. In FIG. 8, a horizontal slider plate 852 bears tabs 840*a* and 840*b* located adjacent a central aperture 854 which is larger than the neck of the kinescope. Plate 852 is positioned in a pair of channels 850*a* and 850*b* which allow motion of plate 852 in the horizontal direction. A drive mechanism for plate 852, not shown, may be coupled to a YAM machine for remote positioning of plate 852 for raster size adjustment.

Other embodiments of the invention will be apparent to those skilled in the art. A friction drive may be used instead of rack 456 and gear 470, slots and screws may be used to retain plate 452 rather than using channels 450, and the longitudinal position at which permeable tabs 440 are located may be selected at other than the rear of the yoke. The gear drive may be integral with and remain a part of the yoke assembly. Also, the gear drive may if desired be at right angles to that shown.

What is claimed is:

1. A convergence correction arrangement for a deflection yoke disposed about and substantially coaxial with the neck of an in-line beam kinescope, comprising:
   first and second magnetic field influencing means disposed contiguous with the yoke for modifying a deflection field developed by said yoke, said first and second field influencing means being located at positions diametrically opposed with respect to the axis of said kinescope neck; and
   mounting means for maintaining a fixed separation between said first and second field influencing means and for providing for simultaneous differential adjustment of the proximity of said first and second means to said kinescope neck axis.

2. An arrangement according to claim 1 wherein said first and second magnetic field influencing means comprise magnetically permeable tabs.

3. An arrangement according to claim 1 wherein said first and second field influencing means are disposed near the entrance end of said yoke.

4. An arrangement according to claim 1 wherein said mounting means comprises a member for maintaining a fixed separation between said first and second field influencing means, for simultaneous linear translation of said member, said first and second field influencing means along a path perpendicular to said axis.

5. An arrangement according to claim 4 wherein said member defines an aperture larger than the neck of the kinescope.

6. An arrangement according to claim 4 further comprising a guide channel associated with said yoke for restraining said member against motion except along said path perpendicular to said axis.

7. An arrangement according to claims 5 or 6 wherein said path is substantially vertical.

8. An arrangement according to claims 5 or 6 wherein said path is substantially horizontal.

9. An arrangement according to claim 6 wherein said member includes a rack by which its position relative to said channel may be adjusted.

10. A convergence correction arrangement for a deflection yoke adapted to be disposed about and substantially coaxial with an in-line beam kinescope, comprising:

first and second magnetic field influencing means disposed contiguous with the yoke, said first and second influencing means being located on opposite sides of the axis;

mounting means for maintaining a fixed separation between said first and second field influencing means and for providing for simultaneous differential adjustment of the proximity of said first and second means to said axis;

wherein said first and second field influencing means comprise first and second magnetically permeable tabs, and wherein said mounting means comprises a first member for maintaining a fixed separation between said first and second tabs and for providing for simultaneous linear translation of said member, said first and second tabs along a vertical path adjacent the beam entrance-end of said yoke;

third and fourth tabs disposed on opposite sides of said axis adjacent the beam entrance end of said yoke; and second mounting means coupled to said third and fourth tabs, said second mounting means comprising a second member for maintaining a fixed separation between said third and fourth tabs and for providing for simultaneous linear translation of said member, said second and third tabs in a direction orthogonal to said vertical path.

11. A method for adjusting a deflection field providing by a deflection yoke mounted on a multibeam kinescope, comprising in order the steps of:

vertically translating said yoke relative to said kinescope to a translated position at which the least amount of pincushion raster distortion is produced; and simultaneously differentially adjusting the proximity to the kinescope axis of first and second magnetically permeable field influencing tab means, located adjacent to the entrance end of said yoke at positions diametrically opposed with respect to the kinescope axis, to modify a deflection field provided by said yoke at said translated position for best beam convergence.

* * * * *